US006234098B1

(12) United States Patent
Biedenweg et al.

(10) Patent No.: US 6,234,098 B1
(45) Date of Patent: May 22, 2001

(54) EXTENDED WIDTH SIDE RAIL FOR PONTOON BOAT

(75) Inventors: Baron R. Biedenweg, Fort Wayne; David L. Putman, Rome City; Jerome Ruda, Fort Wayne, all of IN (US)

(73) Assignee: Harris Kayot, Inc., Fort Wayne, IN (US)

( * ) Notice: Subject to any disclaimer, the term of this patent is extended or adjusted under 35 U.S.C. 154(b) by 0 days.

(21) Appl. No.: 09/340,267

(22) Filed: Jun. 25, 1999

Related U.S. Application Data

(60) Provisional application No. 60/091,025, filed on Jun. 29, 1998.

(51) Int. Cl.[7] ..... B63B 3/00

(52) U.S. Cl. ..... 114/85; 114/61.1

(58) Field of Search ..... 114/39.28, 61.1, 114/61.15, 61.18, 61.22, 85, 219

(56) References Cited

U.S. PATENT DOCUMENTS

| | | | | |
|---|---|---|---|---|
| 3,065,724 | * | 11/1962 | Tritt | 114/219 |
| 3,630,163 | | 12/1971 | Williams | 114/61 |
| 4,517,911 | | 5/1985 | Seefeld | 114/267 |
| 4,562,786 | | 1/1986 | Pruonto | 114/61 |
| 4,738,215 | | 4/1988 | McMahon | 114/219 |
| 4,892,052 | | 1/1990 | Zook et al. | 114/85 |
| 5,085,165 | | 2/1992 | Reed | 114/362 |
| 6,003,458 | * | 12/1999 | Valliere | 114/61.18 |

FOREIGN PATENT DOCUMENTS 1473018 3/1967 (FR) .

* cited by examiner

*Primary Examiner*—Ed Swinehart
(74) *Attorney, Agent, or Firm*—Baker & Daniels

(57) ABSTRACT

A pontoon boat having a flotation device, a deck, and a pair of side rails. The flotation device includes at least two pontoons and a support frame extending between the pontoons and having a pair of side edges. The deck is disposed atop the flotation device and has a top surface and a pair of side edges. The side rail has a generally angled shape and comprises a generally horizontal leg and a generally vertical leg. A free edge of the horizontal leg overlies a portion of the deck proximal a deck side edge. The vertical second leg depends over the support frame side edge. The horizontal leg substantially, horizontally extends the deck The rails include aligned inboard channels. Adjacent rails connect to one another by means of a plate or other member disposed in and attached to the inboard channel at the terminal ends of two adjoining rails providing for a non-overlapping joint.

30 Claims, 2 Drawing Sheets

EXTENDED WIDTH SIDE RAIL FOR PONTOON BOAT

CROSS-REFERENCE TO RELATED APPLICATIONS

This application claims the benefit under Title 35 U.S.C. 119(e) of U.S. Provisional Patent Application Ser. No. 60/091,025, filed Jun. 29, 1998, entitled "Extended Width Side Rail For Pontoon Boat".

BACKGROUND OF THE INVENTION

The invention relates to a rail structure disposed around the peripheral edge of the deck of a pontoon boat. The rail structure, which is usually made from aluminum, is fitted against and over the carpeted deck and secured to the support structure underneath.

Pontoon boat decks are usually manufactured from standard four by eight size plyboard material, arranged such that the deck width is eight feet. Currently, the maximum load width permissible for transportation over U.S. highways without special permits is eight and one half feet In order to provide the widest pontoon boat possible which can be shipped by truck without special permits, it is desirable to widen the deck approximately six inches from that which can be obtained from a standard sized plyboard sheet. Conventionally, to widen the pontoon boat deck beyond its usual eight foot width, specially sized plyboard measuring, for example, four feet by eight feet, six inches, is procured by the boat manufacturer at a substantial premium.

Alternatively, multiple portions of standard sized plyboard sheets may be adjacently placed across the width of the deck on the lateral deck support beams which extend between the pontoons. This method widens the deck relatively inexpensively from a material requirements standpoint, but requires additional fabrication, may result in wasted material and also produces a seam in the deck which extends longitudinally in the fore-aft direction through which water may wet the deck carpeting. Further, although plyboard sheets which are arranged adjacently in the longitudinal (fore-aft) direction result in lateral deck seams, which may comprise tongue and groove joints to which a liquid sealant is applied, these seams are centrally placed upon the uppermost flange of lateral cross members to rigidly support the ends each plyboard sheet and further guard against water splashing onto the joint. A longitudinally extending support beam is normally not available for the longitudinal seam between laterally adjacent pieces of plyboard deck material to lie upon, and thus may compromise the integrity of the deck from water intrusion and/or deck support perspectives. Additionally, a deck having such a longitudinal joint may result in its being weaker than it would otherwise be. A means for inexpensively widening the deck of a pontoon boat from the usual eight foot dimension inexpensively and without compromising its integrity is desirable.

SUMMARY OF THE INVENTION

The present invention permits the width of the pontoon deck to be increased by varying the width of the extruded aluminum rail structure which is disposed at the edge of the decks, maintaining the ability to use standard four foot by eight foot sized plyboard sheets. The horizontal portion of the aluminum rail is increased in width such that standard sized plyboard deck material can be used in pontoon boats of varying widths. Thus, the present invention provides additional and variable width to a pontoon boat deck comprised of standard size plyboard material. The extruded aluminum rail structure includes rib members which run along the bottom of the horizontal surface to provide structural integrity. Further, the inventive deck rail trims the edges of the plyboard deck material and underlying cross members, and may be provided with a rub rail.

The inventive rail has a generally angled shape with one leg having a length which varies with desired boat width, the end of which overlies the top surface of the deck near its outside edge, and another leg which depends over the edge of the deck material and serves as deck trim and which may also include a rub rail.

The present invention provides a pontoon boat including a flotation device, a deck, and a pair of side rails. The flotation device includes at least two pontoons and a support frame extending between the pontoons and having a pair of side edges. The deck is disposed atop the support frame and has a top surface and a pair of side edges. Each side rail has a generally angled shape and comprises a generally horizontal leg and a generally vertical leg. A free edge of the horizontal leg overlies a portion of the deck proximal a deck side edge. The vertical leg depends over the support frame side edge. The horizontal leg substantially, horizontally extends the deck.

The present invention also provides a pontoon boat including a flotation device, a deck, and an extension means for substantially extending the width of the boat. The flotation device includes at least two pontoons and a plurality of lateral deck support beams extending between the pontoons. The deck is disposed atop the support beams and has a top surface and a side edge.

The present invention also provides a pontoon boat including at least two pontoons, a deck, and a pair of rails. The deck extends between the pontoons and has a top surface and a side edge. Each rail has a generally angled shape and comprises a generally horizontal leg which substantially extends the width of the deck, and a generally vertical leg. A free edge of the horizontal leg overlies the top surface of the deck proximal the deck side edge.

The present invention provides a pontoon boat including a flotation device, a deck, and a plurality of rails disposed around the perimeter of the deck. The flotation device includes at least two pontoons and a support frame extending between the pontoons. The deck is disposed atop the support frame. The rails include aligned inboard channels. Adjacent rails connect to one another by means of a plate or other member disposed in and attached to the inboard channel at the terminal ends of the two adjoining rails providing for a non-overlapping joint.

The present invention also provides a boat including a flotation device and a plurality of rails disposed around the perimeter of the flotation device. The rails include aligned inboard channels. Adjacent rails connect to one another by means of a plate or other member disposed in and attached to the inboard channel at the terminal end of two adjoining rails providing for a non-overlapping joint.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
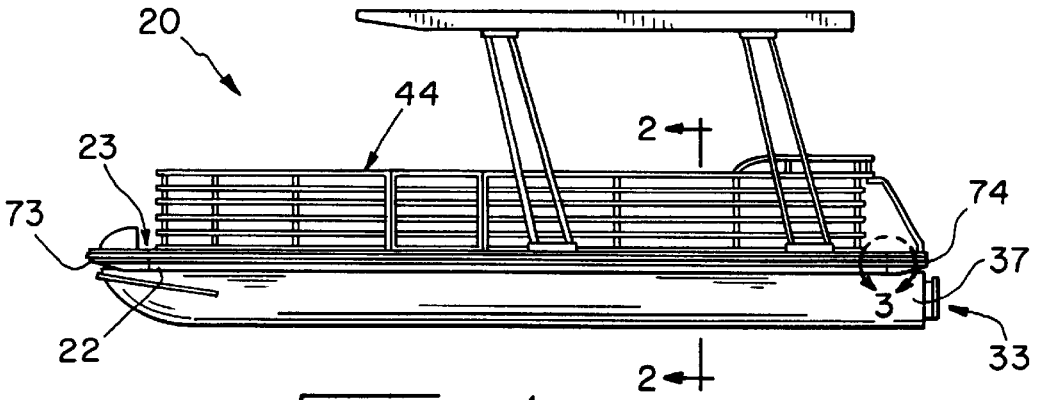
FIG. 1 is an elevational view of a pontoon boat according to the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention, in one form, and such exemplification is not to be construed as limiting the scope of the invention in any manner.

DETAILED DESCRIPTION OF THE INVENTION

Figure 2:
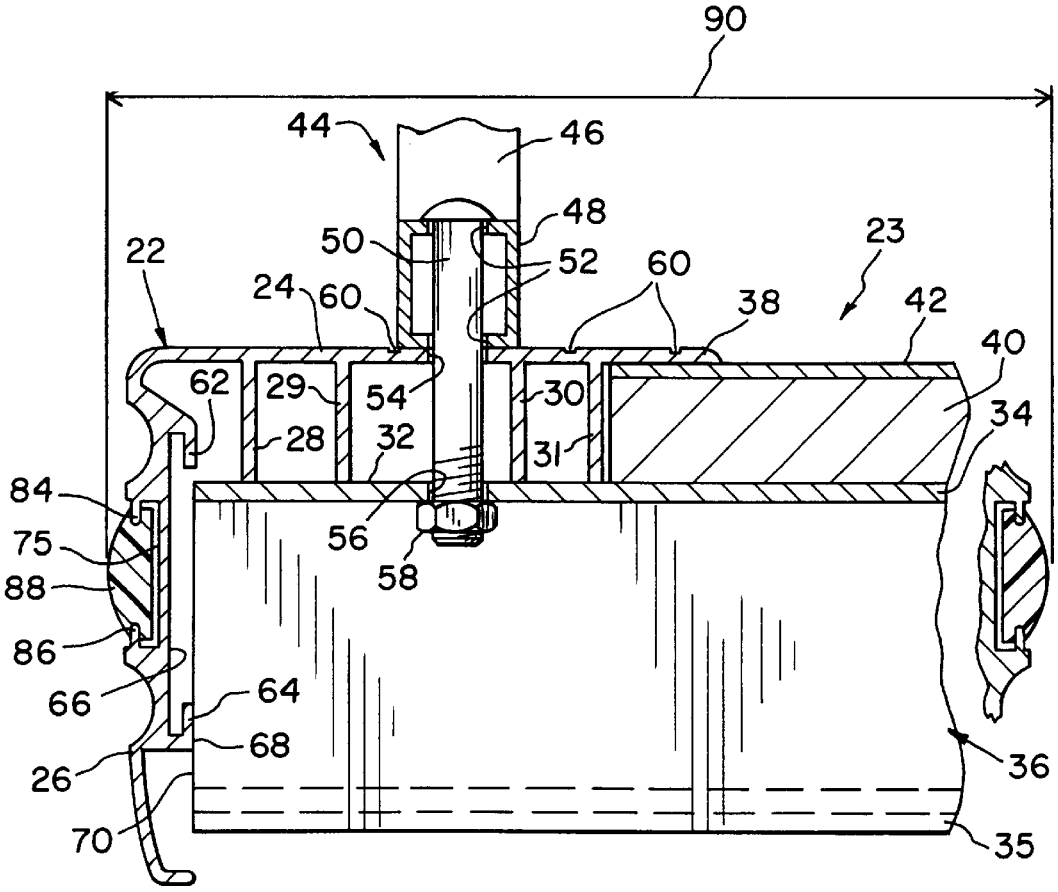
FIG. 2 is an enlarged, fragmentary sectional view along line 2—2 of FIG. 1, showing the inventive extended width rail.

FIG. 1 shows a pontoon boat 20 according to the present invention, comprising flotation device 33, which includes pontoons 37 and a support frame including lateral support beams 36 connected thereto and extending therebetween, and deck 23 disposed on flotation device 33. Support beams 36 may be connected to pontoons 37 through an intermediary bracket (not shown). Boat 20 also comprises extended width side rail 22. FIG. 2 details port side rail 22, which is identical to the starboard side rail (not shown) which is disposed on the opposite lateral side of deck 23. Thus, the following description applies to rails which may be located on each side of the boat, the combination of the side rails widening the boat from its usual dimension of approximately eight feet to, for example, eight feet, six inches, the aforementioned maximum highway load width allowed without special permits. The scope of the present invention should not be construed as being limited to a deck width increase of six inches, however. It is envisioned that the rail of the present invention may be used to substantially widen decks in the manner described whenever, for example, it is desired to use standard sized deck board materials.

Referring to FIG. 2, rail 22, which may be an aluminum extrusion, is generally L-shaped, having horizontal leg 24 and downwardly depending vertical leg 26. Horizontal leg 24 is provided with downwardly extending ribs, 28, 29, 30 and 31, each approximately ⅞ inch in length which abut upper surface 32 of upper flange 34 of lateral deck support beam 36, which may have a Z-shaped (shown) or C-shaped cross section. The ⅞ inch length of ribs 28–31 accommodates the combined height above deck support beam surface 32 of the ¾ inch thick plyboard deck material and its overlying carpet, which is about ⅛ inch thick. Several lateral beams 36 are provided, spaced along the longitudinal (fore-aft) direction. Bottom flange 35 of beam 36 is attached to brackets (not shown) which are attached to each pontoon 37 (FIG. 1). Other configurations of the support frame not employing separate lateral beams are possible.

Horizontal leg 24 is provided with horizontally extending portion 38 which extends inboard from rib 31 and overhangs the adjacent edge of ¾ inch thick deck plyboard 40 and carpeting 42 covering the plyboard. Plyboard 40 abuts upper beam surface 32 and is attached to each lateral beam 36 in the usual manner. Fence 44 is provided around the perimeter of deck 23 and comprises a plurality of interconnected vertical tubes 46 and horizontal tubes 48, which may be aluminum. Bottommost horizontal tube 48 lies atop horizontal leg 24 of rail 22. Fence 44 is attached to the pontoon boat by means of bolts 50 which extend through holes 52, provided in lowermost horizontal fence tube 48, hole 54 provided in horizontal rail leg 24 between ribs 29 and 30, and hole 56 provided in lateral support beam flange 34, and which are secured with nuts 58. It should be noted that fence 44 may be positioned further outboard from its shown position, such that bolts 50 might extend through accommodating holes located between ribs 28 and 29. The upper surface of horizontal rail leg 24 may be provided with longitudinally extending grooves 60 which serve to provide a non-slip surface to help channel water and improve appearance.

The inboard side of vertical rail leg 26 is provided with top and bottom overhanging portions 62, 64 which extend vertically toward each other and define longitudinal channel 66, which will be discussed further below. Bottom overhanging portion 64 has inboard surface 68 which abuts the adjacent end edge 70 of each lateral beam 36. Inwardly directed lateral loads exerted on rail 22 are thus transferred to beams 36 through surface 68 and through bolts 50.

Figure 3:
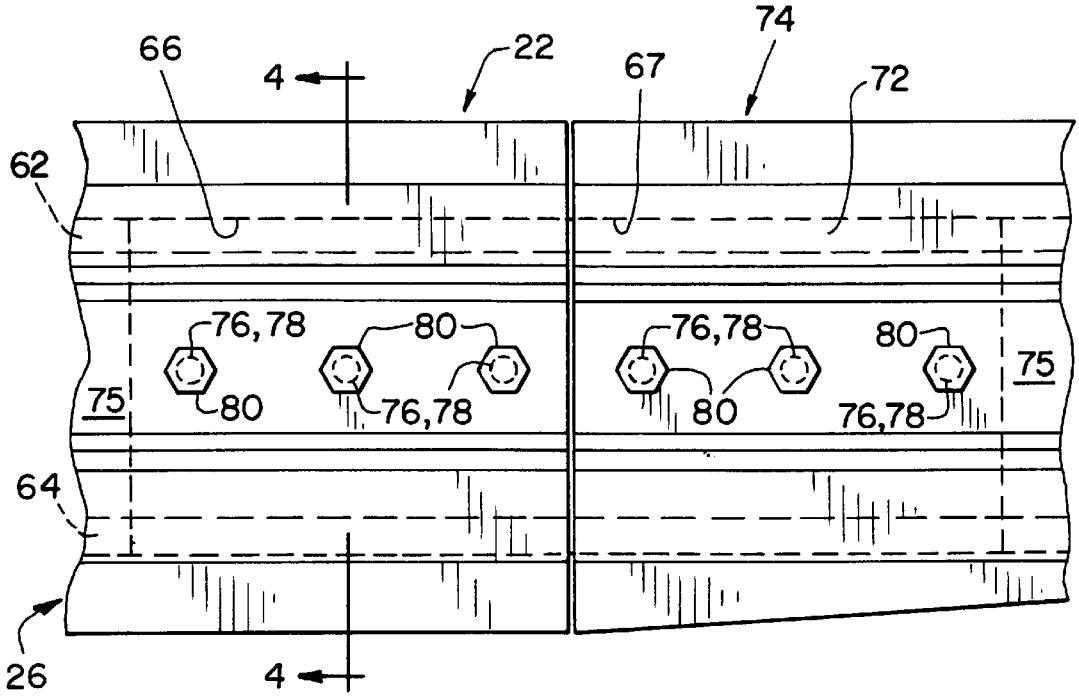
FIG. 3. is an enlarged, inset view of the pontoon boat shown in FIG. 1, showing a joint between rail portions having the insert removed from illustration purposes.
Figure 4:
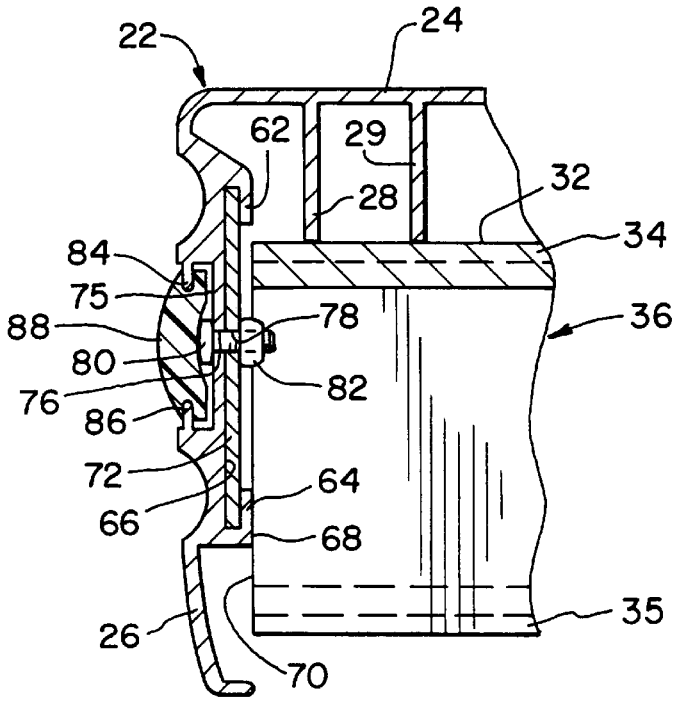
FIG. 4 is a fragmentary, sectional view along line 4—4 of FIG. 3.

The terminal ends of each rail 22 are connected to forward deck rail 73 and aft deck rail 74, each of which are provided with a channel which aligns with channel 66 and may even be configured identically to channel 66. Further, rail 22 and each of forward and aft deck rails 73, 74 are provided with a channel centrally formed in their vertical exterior surfaces. Referring to FIG. 3, aligned channels 75 are shown provided in the exterior surface of vertical leg 26 of side rail 22 and in corresponding exterior surface of aft deck rail 74. The cross sectional profile of channel 75 is shown in FIGS. 2 and 4. Referring to FIGS. 3 and 4, plate 72 is slidably disposed in channel 66 and mating channel 67 provided in aft deck rail 74, extending approximately an equal distance into channels 66 and 67. A plurality of holes 76 are provided near the terminal ends of rail 22 and aft rail 74, longitudinally aligned and centrally disposed within channels 75. Plate 72 is provided with holes 78 which correspond with holes 67. Bolt 80 extends through each pair of aligned holes 76, 78 and is secured with nut 82. Other fasteners such as pop rivets could also be used. Hence, side rail 22 is attached to aft rail 74. Forward rail 73 is similarly attached to side rail 22. Although it is envisioned that a single rail 22 will extend the entire length between forward deck rail 73 and aft deck rail 74, on each side of the boat, a plurality of shorter rails 22 may instead be used, each axially abutting pair of rails 22 connected using plates 72 in the manner described above.

Referring again to FIG. 2, it can be seen that the facing upper and lower horizontal surfaces of channel 75 are respectively provided with projections 84, 86 which extend towards each other and longitudinally along the length of rail 22. Similarly, channels 75 in forward and aft deck rails 73, 74 are also provided such projections. These projections are slidably received in corresponding longitudinal grooves provided in the top and bottom edges of resilient extruded vinyl insert 88. A leading end of insert 88 is inserted into an open end of channel 75 onto projections 84, 86, and continually fed into the channel of each individual rail (side, forward or aft). Alternatively, insert 88 may be fed into an interconnected series of channels aligned by the attachment of the rails with one another, providing a continuous, unbroken band around the entire outer perimeter of the boat deck. In such an embodiment, a single vertical slot (not shown) may be provided which extends completely through the upper and lower horizontal surfaces of channel 75 at a discreetly chosen location in one of the assembled side, forward or aft rails, into which insert 88 is fed and at which the extruded insert is cut from stock once its starting end has completely surrounded the deck, returning to the vertical slot. The exposed outer surface of insert 88 is crowned, provided with a convex shape, which presents the vinyl insert as the outermost circumferential element of boat 20. Thus, in addition to covering the heads of bolts 80, as shown in FIG. 4, insert 88 provides a resilient bumper or rubbing surface which protects the appearance of rails 22, 73 and 74. Notably, as shown in FIG. 2, overall boat width dimension 90, which may be eight feet, six inches, extends between the outermost points of the crowned insert surface.

While this invention has been described as having an exemplary design, the present invention may be further modified within the spirit and scope of this disclosure. This application is, therefore, intended to cover any variations, uses, or adaptations of the invention using its general principles. Further, this application is intended to cover such departures from the present disclosure as come within known or customary practice in the art to which this invention pertains. Accordingly, the scope of the invention should be determined not by the illustrated embodiment but by the following claims and their legal equivalents.

What is claimed is:

1. A pontoon boat comprising:

a flotation device, said flotation device includes at least two pontoons and a support frame extending between said pontoons, said support frame having a pair of side edges;

a deck disposed atop said support frame and having a top surface and a pair of side edges; and a pair of side rails each having a generally horizontal leg and a generally vertical leg, wherein said horizontal leg overlies and is supported directly by an outboard portion of said frame, a free edge of said horizontal leg overlies a portion of and is disposed above said deck proximate said deck side edge, and said vertical leg depends over a respective said support frame side edge, said horizontal leg horizontally extending said deck.

2. The pontoon boat of claim 1, wherein each said side rail horizontally extends said deck by about three inches.

3. The pontoon boat of claim 1, further comprising a forward deck rail and an aft deck rail, said forward deck rail and said aft deck rail connected to a pair of said side rails, whereby said rails are disposed around the perimeter of said deck.

4. The pontoon boat of claim 1, wherein said support frame includes a plurality of lateral deck support beams.

5. The pontoon boat of claim 1, wherein said side rail includes an outboard channel.

6. The pontoon boat of claim 5, further comprising a trim member disposed within said outboard channel of said side rail.

7. A pontoon boat comprising:

a flotation device, said flotation device includes at least two pontoons and a support frame extending between said pontoons, said support frame having a pair of side edges;

a deck disposed atop said support frame and having a top surface and a pair of side edges; and a pair of side rails each having a generally horizontal leg and a generally vertical leg, wherein said horizontal leg overlies an outboard portion of said frame, a free edge of said horizontal leg overlies a portion of said deck proximate a respective said deck side edge, and said vertical leg depends over a respective said support frame side edge, said horizontal leg horizontally extending said deck;

wherein said deck is provided with a carpet material and said horizontal leg free edge overlies a portion of said material.

8. The pontoon boat of claim 7, wherein said deck includes a plurality of plyboard sheets.

9. A pontoon boat comprising:

a flotation device, said flotation device includes at least two pontoons and a support frame extending between said pontoons, said support frame having a pair of side edges;

a deck disposed atop said support frame and having a top surface and a pair of side edges; and a pair of side rails each having a generally horizontal leg and a generally vertical leg, wherein said horizontal leg overlies an outboard portion of said frame, a free edge of said horizontal leg overlies a portion of said deck proximate a respective said deck side edge, and said vertical leg depends over a respective said support frame side edge, said horizontal leg horizontally extending said deck;

wherein said horizontal leg includes a plurality of vertical ribs abutting said support frame, an inboard said vertical rib being adjacent to said deck side edge.

10. A pontoon boat comprising:

a flotation device, said flotation device includes at least two pontoons and a support frame extending between said pontoons, said support frame having a pair of side edges;

a deck disposed atop said support frame and having a top surface and a pair of side edges; and a pair of side rails each having a generally horizontal leg and a generally vertical leg, wherein said horizontal leg overlies an outboard portion of said frame, a free edge of said horizontal leg overlies a portion of said deck proximate a respective said deck side edge, and said vertical leg depends over a respective said support frame side edge, said horizontal leg horizontally extending said deck;

wherein said horizontal leg includes a hole, said side rail attached to said support frame by means of a fastener extending through said horizontal leg hole.

11. The pontoon boat of claim 10, wherein said support frame includes a hole substantially aligned with said horizontal leg hole, said fastener extending through said support frame hole.

12. The pontoon boat of claim 11, further comprising a fence attached to said side rail.

13. The pontoon boat of claim 12, wherein said fence includes a hole substantially aligned with said horizontal leg hole and said support frame hole, said fastener extending through said fence hole, whereby said fence is attached to said boat.

14. A pontoon boat comprising:

a flotation device, said flotation device includes at least two pontoons and a support frame extending between said pontoons, said support frame having a pair of side edges;

a deck disposed atop said support frame and having a top surface and a pair of side edges; and a pair of side rails each having a generally horizontal leg and a generally vertical leg, wherein said horizontal leg overlies an outboard portion of said frame, a free edge of said horizontal leg overlies a portion of said deck proximate a respective said deck side edge, and said vertical leg depends over a respective said support frame side edge, said horizontal leg horizontally extending said deck, and further comprising a forward deck rail and an aft deck rail, said forward deck rail and said aft deck rail connected to a pair of said side rails, whereby said rails are disposed around the perimeter of said deck;

wherein two adjacent said rails include aligned inboard channels, said rails connected to one another by means of a plate disposed in and attached to said inboard channels at terminal ends of two adjoining said rails.

15. The pontoon boat of claim 14, wherein said plate is attached to a said rail by means of a fastener extending through a hole in said plate and a said inboard channel.

16. The pontoon boat of claim 15, wherein said rails include an outboard channel, said outboard channels in said forward deck rail and said aft deck rail aligned with said outboard channels in said side rails, said holes in said inboard channels of said rails extending through said outboard channel.

17. The pontoon boat of claim 16, further comprising a trim member disposed within said outboard channels of said side rail, said forward deck rail and said aft deck rail to cover said plate fasteners.

18. The pontoon boat of claim 17, wherein said trim member is an extruded vinyl insert and creates a rub bumper.

19. A pontoon boat comprising:

a flotation device, said flotation device includes at least two pontoons and a support frame extending between said pontoons, said support frame having a pair of side edges;

a deck disposed atop said support frame and having a top surface and a pair of side edges; and a pair of side rails each having a generally horizontal leg and a generally vertical leg, wherein said horizontal leg overlies an outboard portion of said frame, a free edge of said horizontal leg overlies a portion of said deck proximate a respective said deck side edge, and said vertical leg depends over a respective said support frame side edge, said horizontal leg horizontally extending said deck;

wherein said horizontal leg includes longitudinal extending grooves on the top of said horizontal leg, to provide a non-slip surface and to enable water to be channeled from the top surface of said horizontal leg.

20. A pontoon boat comprising:

a flotation device, said flotation device includes at least two pontoons and a support frame extending between said pontoons, said support frame having a pair of side edges;

a deck disposed atop said support frame and having a top surface and a pair of side edges; and a pair of side rails each having a generally horizontal leg and a generally vertical leg, wherein said horizontal leg overlies an outboard portion of said frame, a free edge of said horizontal leg overlies a portion of said deck proximate a respective said deck side edge, and said vertical leg depends over a respective said support frame side edge, said horizontal leg horizontally extending said deck; and further comprising a fence attached to said side rail.

21. A pontoon boat comprising:

a flotation device, said flotation device including at least two pontoons and a support frame extending between said pontoons, said support frame having a pair of side edges;

a deck disposed atop said support beams and having a top surface and a pair of side edges; and extension means for extending the width of said boat, said extension means being supported directly by said frame and having a portion thereof disposed above said deck.

22. The pontoon boat of claim 21, wherein said extension means extends the width of said boat by about six inches.

23. The pontoon boat of claim 21, wherein said extension means comprises a side rail having a generally horizontal leg and a generally vertical leg, said horizontal leg overlying a portion of said deck proximal a said deck side edge, said vertical leg depending over a said support frame side edge.

24. A pontoon boat comprising:

at least two pontoons;

a support frame disposed between said pontoons;

a deck extending between said pontoons and having a top surface and a pair of side edges; and a pair of rails each having a generally angled shape and comprising a generally horizontal leg which horizontally extends said deck and a generally vertical leg, a free edge of said horizontal leg overlies said top surface of said deck proximal said deck side edge, said horizontal leg supported directly by said frame and having a portion thereof disposed above said top surface of said deck.

25. A pontoon boat comprising:

a flotation device, said flotation device includes at least two pontoons and a support frame extending between said pontoons;

a deck disposed atop said support frame; and a plurality of rails disposed around the perimeter of said deck, said rails including aligned inboard channels, adjacent said rails connected to one another in end-to-end fashion by means of a plate disposed in and attached to said inboard channel at terminal ends of two adjoining said rails providing for a non-overlap joint.

26. The pontoon boat of claim 25, wherein said plate is attached to a said rail by means of a fastener extending through a hole in said plate and a said inboard channel.

27. The pontoon boat of claim 26, wherein said rails include aligned outboard channels, said holes in said inboard channels of said rails extending through said outboard channel.

28. The pontoon boat of claim 27, further comprising a trim member disposed within said outboard channels of said rails to cover said plate fasteners.

29. The pontoon boat of claim 28, wherein said trim member is an extruded vinyl insert and creates a rub bumper.

30. A boat comprising:

a flotation device and a plurality of rails disposed around the perimeter of said flotation device, said rails including aligned inboard channels, adjacent said rails connected to one another in end-to-end fashion by means of a plate disposed in and attached to said inboard channel at terminal ends of two adjoining said rails providing for a non-overlap joint.

* * * * *